US010405640B2

(12) United States Patent
Coleman

(10) Patent No.: US 10,405,640 B2
(45) Date of Patent: Sep. 10, 2019

(54) DEVICES HAVING VISIBILITY-ENHANCING FEATURES FOR PEDESTRIANS

(71) Applicant: Kim Coleman, Milwaukee, WI (US)

(72) Inventor: Kim Coleman, Milwaukee, WI (US)

( * ) Notice: Subject to any disclaimer, the term of this patent is extended or adjusted under 35 U.S.C. 154(b) by 0 days.

(21) Appl. No.: 14/665,340

(22) Filed: Mar. 23, 2015

(65) Prior Publication Data

US 2015/0264986 A1 Sep. 24, 2015

Related U.S. Application Data

(60) Provisional application No. 61/968,706, filed on Mar. 21, 2014.

(51) Int. Cl.

| | |
|---|---|
| ***A41D 13/01*** | (2006.01) |
| ***A45F 3/04*** | (2006.01) |
| ***F21V 21/08*** | (2006.01) |
| *A45F 3/00* | (2006.01) |
| *G08B 5/00* | (2006.01) |

(52) U.S. Cl.

CPC ..... *A45F 3/042* (2013.01); *A45F 2003/001* (2013.01); *A45F 2003/003* (2013.01); *G08B 5/004* (2013.01); *G08B 5/006* (2013.01)

(58) Field of Classification Search

CPC ..... A45F 2003/001; A45F 2003/003; A45F 3/042; A41D 13/01; A41D 27/085; A41D 27/08; G08B 5/004; G08B 5/006; G08B 5/36; G08B 5/38

USPC ..... 362/103, 108, 806, 156, 249.14, 249.16, 362/570, 191

See application file for complete search history.

(56) References Cited

U.S. PATENT DOCUMENTS

| | | | | |
|---|---|---|---|---|
| 6,499,857 | B1 * | 12/2002 | Lumley | A43B 1/0036 362/103 |
| 7,377,663 | B2 * | 5/2008 | Desjardin | A41D 13/01 362/103 |
| 7,892,064 | B2 * | 2/2011 | Carruth | A63H 33/00 190/109 |
| 8,282,235 | B2 * | 10/2012 | Gilligan | A45C 15/06 362/156 |
| D683,537 | S * | 6/2013 | Bandru | D3/217 |
| 8,926,392 | B2 * | 1/2015 | Strong | B65D 25/28 446/197 |
| D722,234 | S * | 2/2015 | BenDavid | D3/223 |
| 2008/0173686 | A1 * | 7/2008 | Kennedy | A63J 7/00 224/600 |

* cited by examiner

*Primary Examiner* — Karabi Guharay
*Assistant Examiner* — Arman B Fallahkhair

(57) ABSTRACT

Embodiments relate to visibility-enhancing objects and systems. These embodiments include visibility-enhancing portions can include a reflective portion and/or a light source. In some embodiments, a connecter is adapted to removably attach a visibility-enhancing portion to a container. Such containers can include at least one strap, and the visibility-enhancing portion can be arranged between the container and one a strap, to extend at least partially beyond a perimeter of the container to increase visibility of the wearer.

6 Claims, 9 Drawing Sheets

Original Velcro (222) has been previously presented. Modified version is attached

DEVICES HAVING VISIBILITY-ENHANCING FEATURES FOR PEDESTRIANS

RELATED APPLICATION

The present application claims the benefit of U.S. Provisional Application No. 61/968,706 entitled "A BOOK BAG THAT HAS WINGS WITH LIGHTS AND REFLECTORS FOR THE SAFETY OF CHILDREN TO BE SEEN BY DRIVERS AT NIGHT WHEN CHILDREN HAS TO CROSS STREETS AND WALKING TO THEIR DESTINATION," filed Mar. 21, 2014, which is incorporated herein by reference in its entirety.

TECHNICAL FIELD

Embodiments relate to sacks or packs carried on the body, and more particularly to sacks or packs carried on the body by means of two straps passing over the two shoulders, such as a backpack, combined with a light or other safety features that enhance visibility of the wearer.

BACKGROUND

Pedestrians, and especially children, can be difficult to see, especially in dusk or dark conditions by motorists. These conditions can increase the chances that a child could be struck by a motor vehicle while crossing a street. The times of day that can be the most dangerous for street crossings can, unfortunately, correspond with the beginning and end to the school day, when many children are walking to and from their classes.

This safety concern has been recognized, and several conventional methods have been adopted to promote child safety. For example, crossing guards, reduced speed zones, and lit and painted crosswalks are often found in close proximity to schools. However, these conventional solutions do not necessarily help all students, for example those who walk a substantial distance from the school zone, or children who for any other reason do not walk within the areas that are protected by crossing guards, lights, etc. Many of these conventional solutions, such as crossing-guard flags, are sufficiently bulky to prevent a small child from carrying one to areas outside of the protected school zone.

In order to promote pedestrian safety, it is desirable to increase safety of pedestrians such as school children, including outside of highly protected crossing areas. It is also desirable to provide a solution that is sufficiently mobile for even a small child to transport easily.

SUMMARY

Embodiments relate to a visibility-enhancing system comprising a container, at least one strap extending from the container, and a visibility-enhancing portion arranged between the container and one of the at least one strap. The visibility-enhancing portion includes a visibility-enhancing element, and extends at least partially beyond a perimeter of the container to increase visibility.

According to another embodiment, a visibility-enhancing portion includes a reflective portion, a light source, and at least one connector. The connecter is adapted to removably attach the visibility-enhancing portion to a container. A first dimension of the visibility-enhancing portion exceeds a second dimension of the container.

DETAILED DESCRIPTION OF THE DRAWINGS

In order to enhance the safety of pedestrians, and especially school-children, embodiments relate to visibility-enhancing devices and features that can be integrated with objects already carried by those children. In one embodiment, a backpack comprises reflective elements, as well as a detachable, visibility-enhancing element. In some embodiments, the backpack and/or the detachable element can include lights to further enhance visibility. In still further embodiments, the backpack and/or the detachable element can be shaped and/or patterned to appeal to children, as described in more detail with respect to the particular embodiments depicted in the Figures, for example.

Figure 1A:
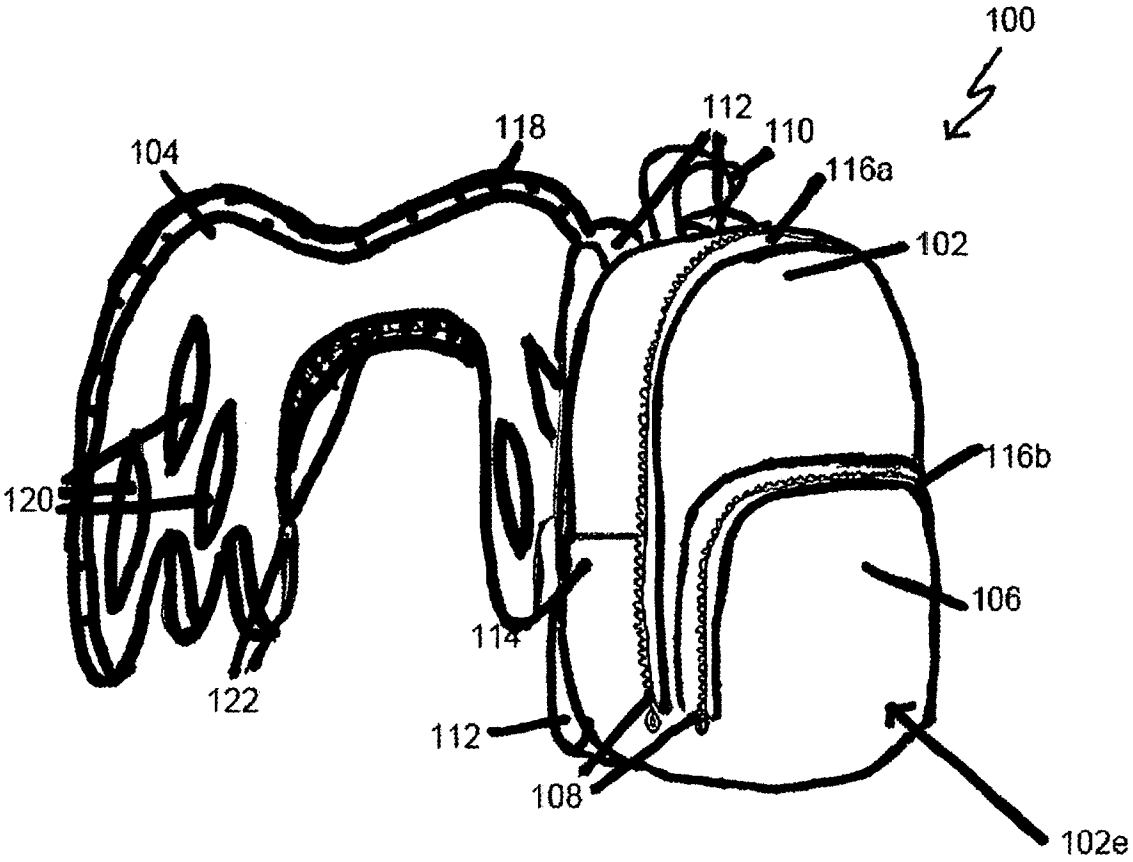
FIGS. 1A-1C depict a backpack and a visibility-enhancing portion, according to an embodiment.
Figure 1B:
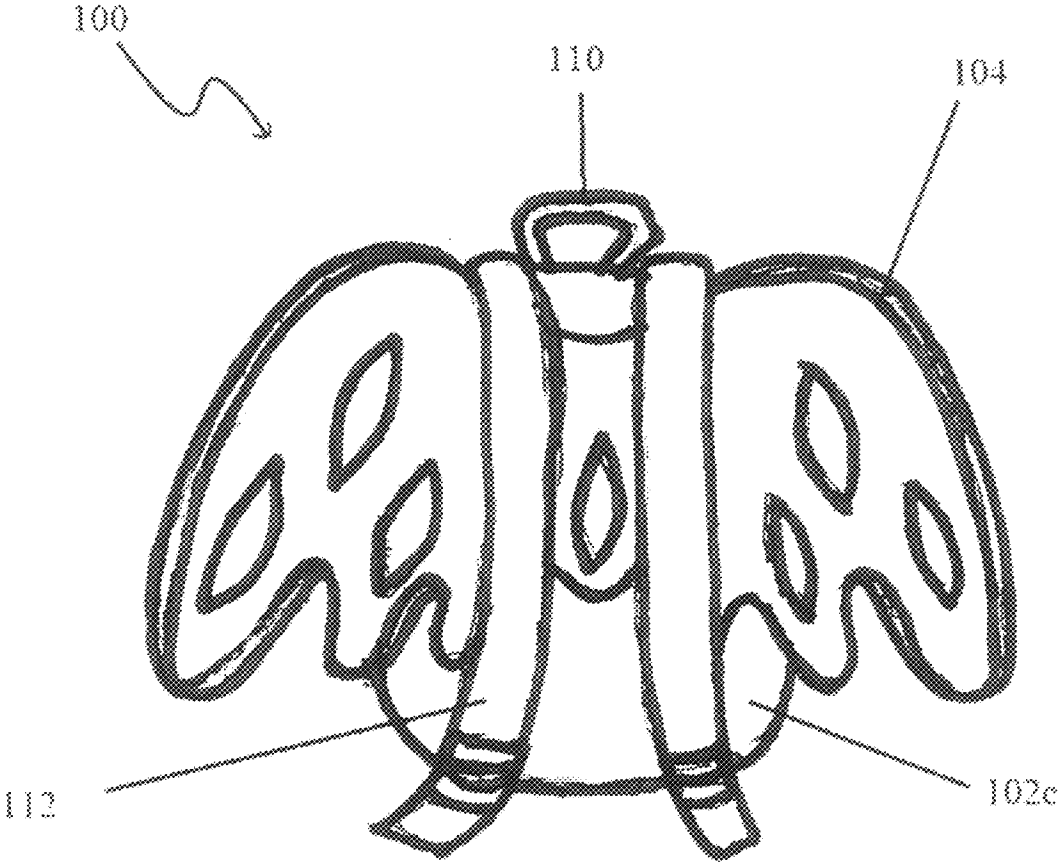
Figure 1C:
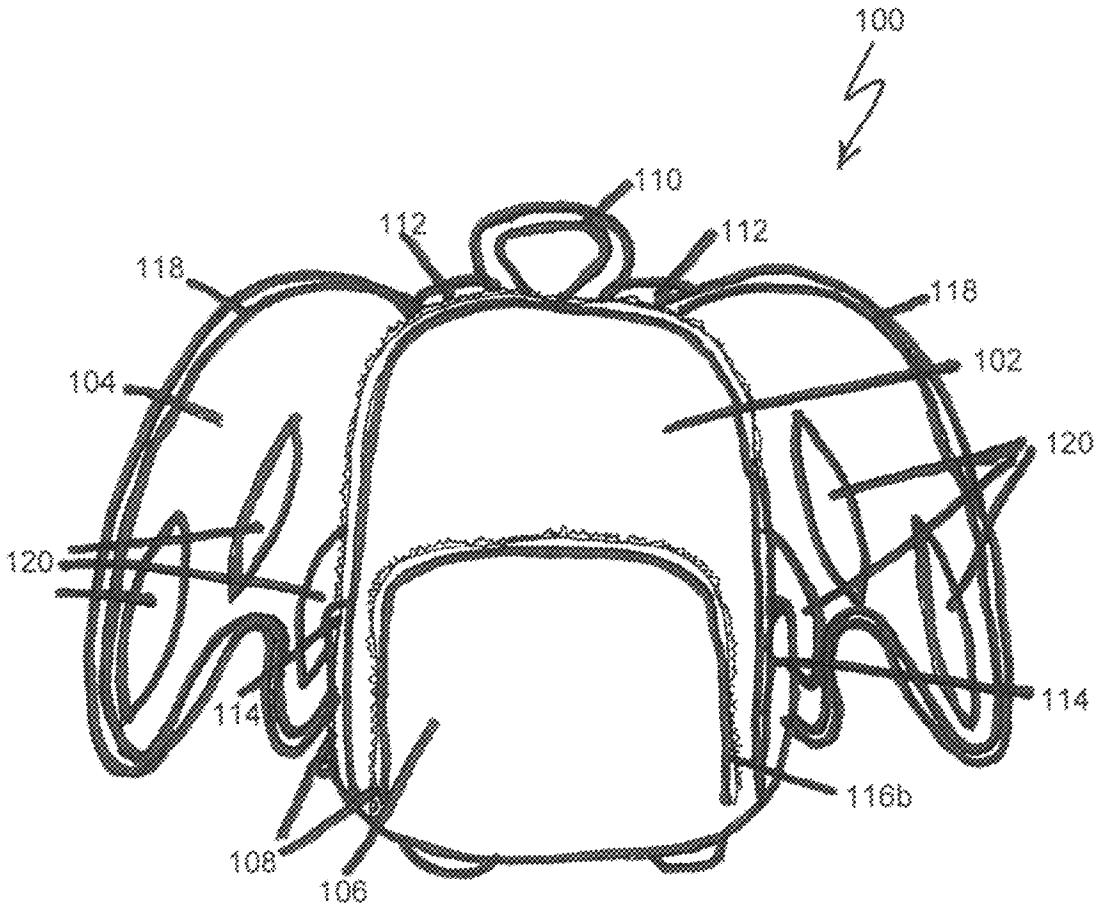

FIGS. 1A-1C shows a system 100 including a backpack 102 and a detachable portion 104, which, in the embodiment shown in FIGS. 1A-1C, is an angel wing-shaped element. Backpack 102 includes exposed portion 102*e* and a covered portion 102*c*. In the embodiment shown in FIGS. 1A-1C, backpack 102 includes front pocket compartment 106, zippers 108, hanger strap 110, back straps 112, and side pocket 114. Additionally, backpack 102 includes safety features such as reflective edges 116*a* and 116*b*. Detachable wings 104 also include safety features, such as LED lights 118 and reflective feathers 120. Backpack 102 and detachable wings 104 can be connected to one another, such as by connectors 122.

Backpack 102 includes several features for containment or storage of books, school supplies, a packed lunch, etc., which are commonly needed by school children. As such, backpack 102 could be used each school day by a child on his or her walk to school. In contrast to conventionally known book bags and backpacks, backpack 102 is more highly visible to drivers, due at least in part to reflective edges 116*a* and 116*b*, which are arranged adjacent to zippers 108 in the embodiment shown in FIG. 1.

Reflective edges 116*a* and 116*b* can be any type of high-visibility objects, such as light-colored objects with high albedo, commercially available reflective strips, or retroreflective strips. In embodiments, reflective edges 116*a* and 116*b* could be replaced by or in addition to other reflective, visibility-enhancing features such as other reflective patches or patterns that are on or make up at least the exposed portion 102*e* of backpack 102. In embodiments, reflective edges 116*a* and 116*b*, and/or other visibility-enhancing features, can have various colors, shapes, and sizes to appeal to children or a particular subset of children, or to further enhance visibility. These visibility-enhancing features could be LED strips, stitching, and could be located elsewhere in or on the backpack or detachable portion, rather than at the edges.

In alternative embodiments, backpack 102 could be, for example, a shoulder bag, messenger bag, or other carrying device. Furthermore, backpack 102 could have relatively more or fewer front compartments 106, zippers 108, hanging straps 110, back straps 112, side compartments 114, reflective edges 116*a*, 116*b*, and/or other features.

Backpack 102 is depicted in FIG. 1A with exposed portion 102*e* showing. In general, when worn by a child, a book carrier such as backpack 102 will have some portion against the wearer, and another portion that is not adjacent to the wearer and is therefore visible to others, such as motorists. In general, it is desirable to affix visibility-enhancing features, such as reflective edges 116*a* and 116*b*, on the exposed portion 102*e*.

The covered portion (102*c*, not shown in this view), which makes up the remainder of backpack 102, connects to still further visibility-enhancing features. For example, in the embodiment shown in FIGS. 1A-1C, detachable portion 104, which can include LED lights 118 and reflective feathers 120, are attached to covered portion 102*c* via connectors 122.

LED lights 118 and reflective feathers 120 further increase the visibility of the wearer of the system 100. By adding LED lights 118, the wearer of the backpack can be seen more easily, without requiring an external light source such as a reflector. Reflective feathers 120 provide additional visibility because they extend beyond the backpack and wearer, and can be at least partially movable to further increase visibility. Reflective feathers 120, in addition to providing additional visibility, combine with the shape of detachable wings 104 to provide the appearance of an angel wing. This appearance can be useful, for example, to make wearing the system 100 more appealing to children, and promoting their safety. Of course, in alternative embodiments, LED lights 118 could be replaced by or supplemented with other light-emitting or reflective features, such as non-LED lights. Detachable portion 104, in alternative embodiments, need not be limited to feather-shaped reflectors. In fact, detachable portions such as wing portion 104 could be made entirely of reflective material, or could have reflective portions in other shapes or sizes than that shown in FIGS. 1A-1C.

Connectors 122 are, in the embodiment depicted in FIGS. 1A-1C, hook-and-loop strips. Various other connectors 122 can be used, including removably coupleable mechanical fasteners, adhesives, safety pins, magnets, zippers, snaps, or even semi-permanent mechanical fasteners such as stitches. However, readily removable connectors 122 such as hook and loop can be useful in that the backpack 102 can be used with a variety of different detachable elements, or even with non-detachable elements and permanent fasteners, as desired.

As can be appreciated from FIGS. 1A-1C, connectors 122 can be used to attach backpack 102 with detachable wings 104 to form a system 100 that enhances visibility of a wearer, such as a schoolchild, to others, such as motorists. In the embodiment shown in FIGS. 1A-1C, these visibility-enhancing features increase visible light output from the system 100. In other embodiments, these features could be supplemented by other features such as movable/moving elements. For example, in alternative embodiments, detachable wings 104 could be connected to a motive source such as an electric motor or a pull cord so that they can "flutter." In some embodiments, this fluttering motion could even be the result of movement within the surrounding environment or due to the movements of the wearer. In other embodiments, such as where detachable wings 104 take alternative shapes such as an airplane wing, lights could be operated in patterns similar to those of an airplane's wings. These and other features can simultaneously promote visibility of the wearer, and increase the attractiveness of the system 100 to children.

FIG. 1C depicts the system 100 assembled such that detachable wings 104 are attached to backpack 102. The view shown in FIG. 1C is similar to the view of system 100 that could be seen by a motorist behind a child wearing system 100. As shown in FIG. 1C, reflective edges 116*a* and 116*b*, LED lights 118, and reflective feathers 120 are all seen from this view, which can promote the visibility and safety of a child wearing the system 100. To be visible from various angles, the detachable portion, including visibility-enhancing features, has a dimension that is larger than at least one of the dimensions of the backpack 102. That is, the detachable portion extends out beyond the backpack 102, so that it forms a part of the silhouette of the system 100 and is visible, for example, from behind the system 100. In this way, the wearer is highly visible to others, such as vehicle drivers.

Figure 2:
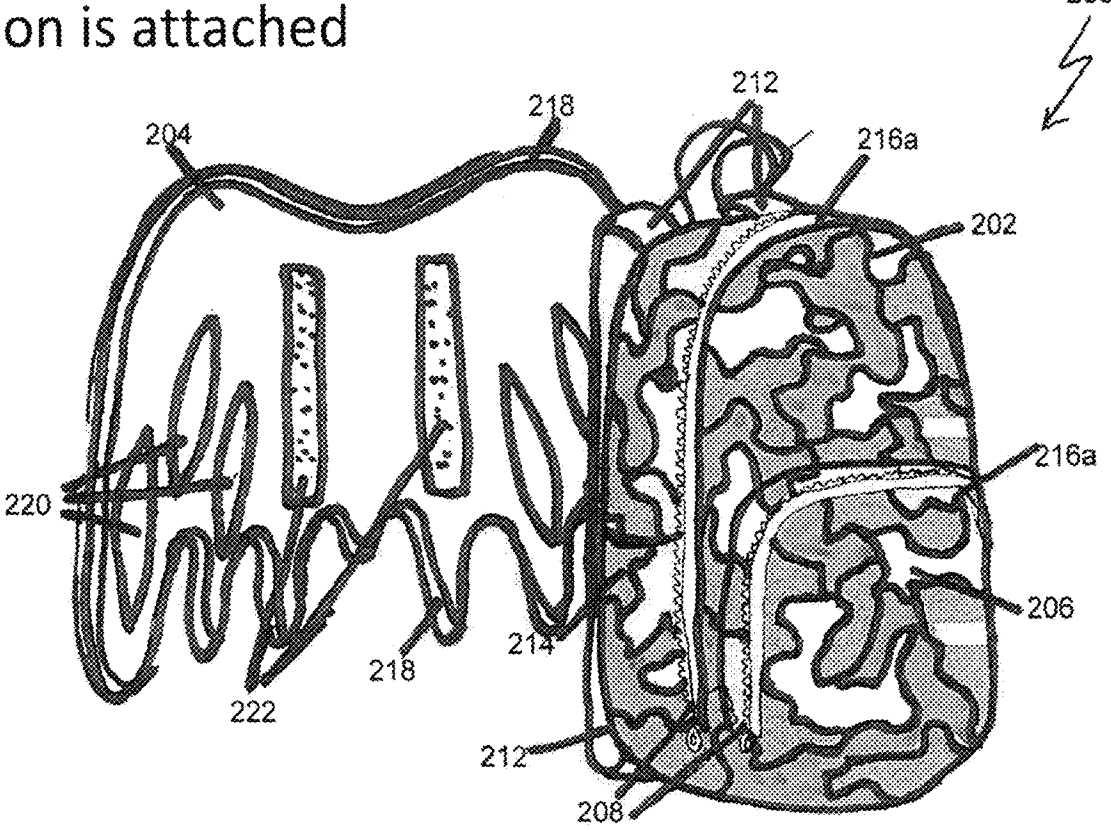
FIG. 2 is an exploded view of a backpack having a printed portion, and a visibility-enhancing attachment, according to another embodiment.

FIG. 2 shows another embodiment of a system 200. System 200 includes many parts that are similar to those previously described with respect to FIGS. 1A-1C. Generally speaking, elements of system 200 (FIG. 2) that are similar to those previously described with respect to system 100 (FIGS. 1A-1C) have reference numerals that have merely been iterated by a factor of 100. This convention is used throughout the application to refer to like parts in Figures showing different embodiments.

In particular, system 200 includes backpack 202 and detachable wings 204. Backpack 202 is similar to backpack 102, in that backpack 202 includes front pocket compartment 206, zippers 208, hanger strap 210, back straps 212, side pocket 214, and reflective edges 216*a* and 216*b*. Likewise, detachable wings 204 include LED lights 218, reflective features 220, and connectors 222, which are similar to the structures previously described with respect to detachable wings 104 as shown in FIGS. 1A-1C.

In addition to the features previously described with respect to the embodiment shown in FIGS. 1A-1C, system 200 may be more appealing to some children due to the camouflage pattern shown on backpack 202. This pattern can also be used to increase visibility. It should be understood that, in addition to camouflage, various other patterns or colors can be used, such as stripes, dots, animal prints, or other patterns. These colors or patterns can be chosen to increase visibility. So, for example, even a camouflage pattern can be highly visible when made using pink, orange, yellow, or other bright colors, for example.

Again, as previously described with respect to FIGS. 1A-1C, the detachable portion 204 has at least one dimension that is larger than a dimension of backpack 202. In this way, the detachable portion 204, including any light-emitting or reflective portions, is visible to others, in almost any orientation, especially from in front or behind the user of the system 200.

Figure 3A:
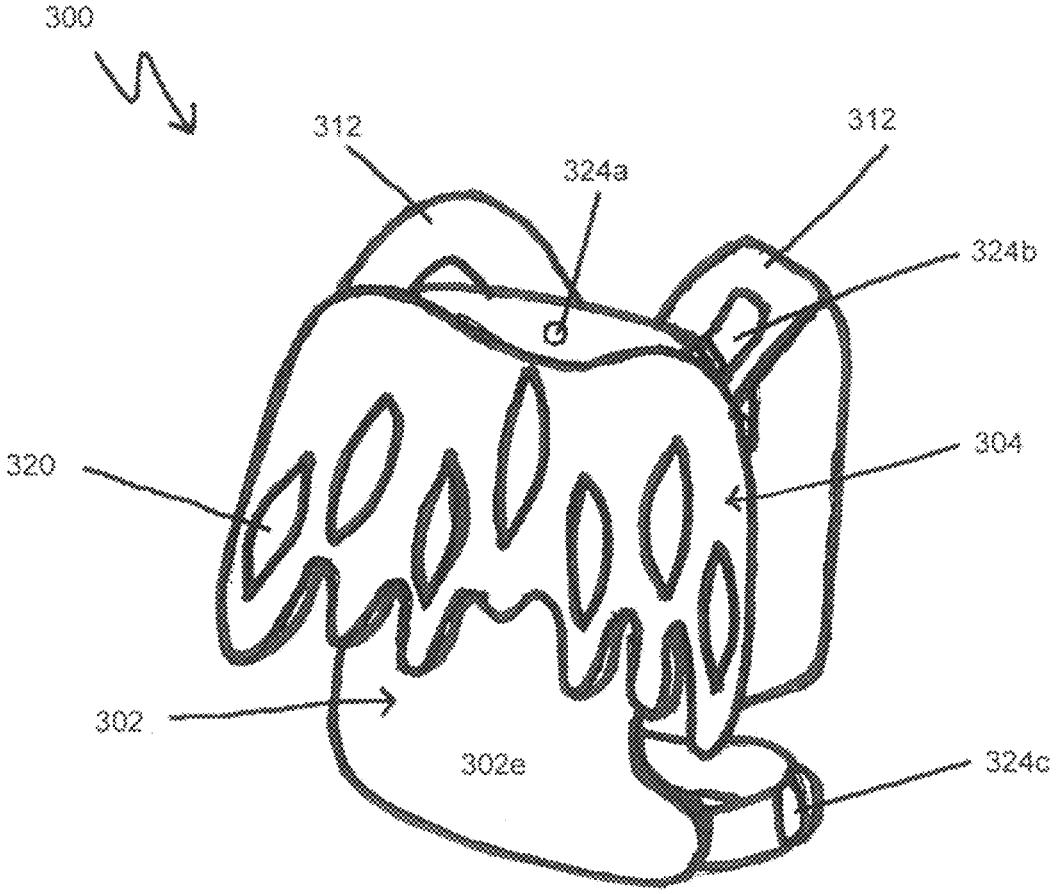
FIGS. 3A-3B show an infant carrier and a visibility-enhancing portion, according to another embodiment.
Figure 3B:
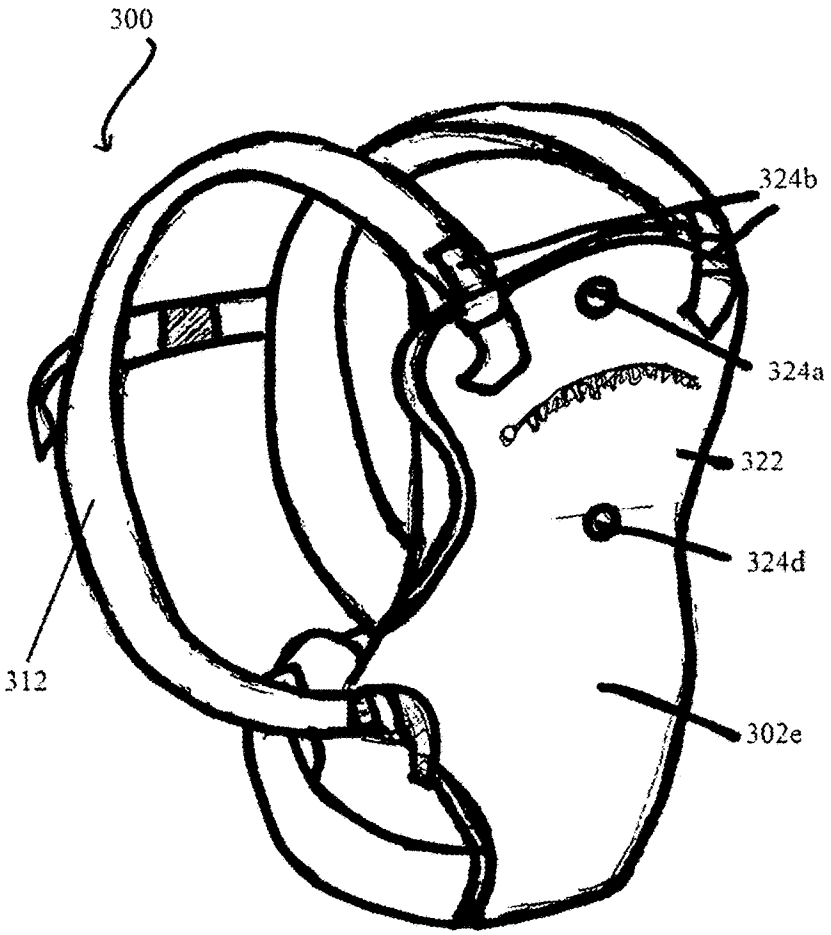

FIGS. 3A-3B depict another embodiment of a safety-enhancing system 300 for pedestrians. FIG. 3A is a perspective view of a system 300 that can enhance visibility for a different type of wearer than the systems 100 and 200 previously described with respect to FIGS. 1-2. In particular, system 300 can be used as a carrier for an infant, rather than school supplies. As shown in FIGS. 3A-3B, system 300 includes a carrier 302 and a detachable wing 304. Carrier 302 includes shoulder straps 312, as well as couplers 324*a*, 324*b*, and 324*c*. Detachable wing 304 includes components similar to those previously described with respect to other embodiments, such as LED lights 318 and reflective feathers 320. In some embodiments, detachable wing 304 can be attached or detached from carrier 302 at a connector or connectors (not shown) such as a hook and loop coupler, a permanent mechanical coupling, or a temporary mechanical coupling, or others as discussed above with respect to FIGS. 1A-1C.

Although the embodiment shown in FIGS. 3A-3B is still a visibility-enhancing system for a carrier, it is different from that of the previously-shown embodiments in several ways. First, the carrier 302 is designed for carrying a child, not books or school supplies. As such, couplers 324*a*-324*c* are provided, which permit for an infant to be safely and comfortably strapped into the carrier 302. Second, detachable wing 304 is arranged on the exposed portion 302*e* of the carrier 302. Thus, rather than enhancing visibility of schoolchildren, the system 300 shown in FIG. 3 could be used by a parent or other caretaker, walking with an infant in the carrier 302.

As shown herein, the detachable wing 302 shown in FIGS. 3A-3B has the same general layout as the detachable wing 102 of FIGS. 1A-1C, and detachable wing 202 of FIG. 2. This illustrates an advantage of the detachable nature of these components. A family having multiple containers, such as multiple childrens' bookbags, or a bookbag and a strap-on carrier for an infant, can share the same detachable, visibility-enhancing components. Furthermore, children may wish to replace their detachable, visibility-enhancing features, as their tastes change or as they get older. Because the depicted wings (102, 202, 302) can all be detachable, it is possible not only to move them around between carriers, but also to replace them with new and/or differently styled detachable visibility-enhancing components.

Figure 4A:
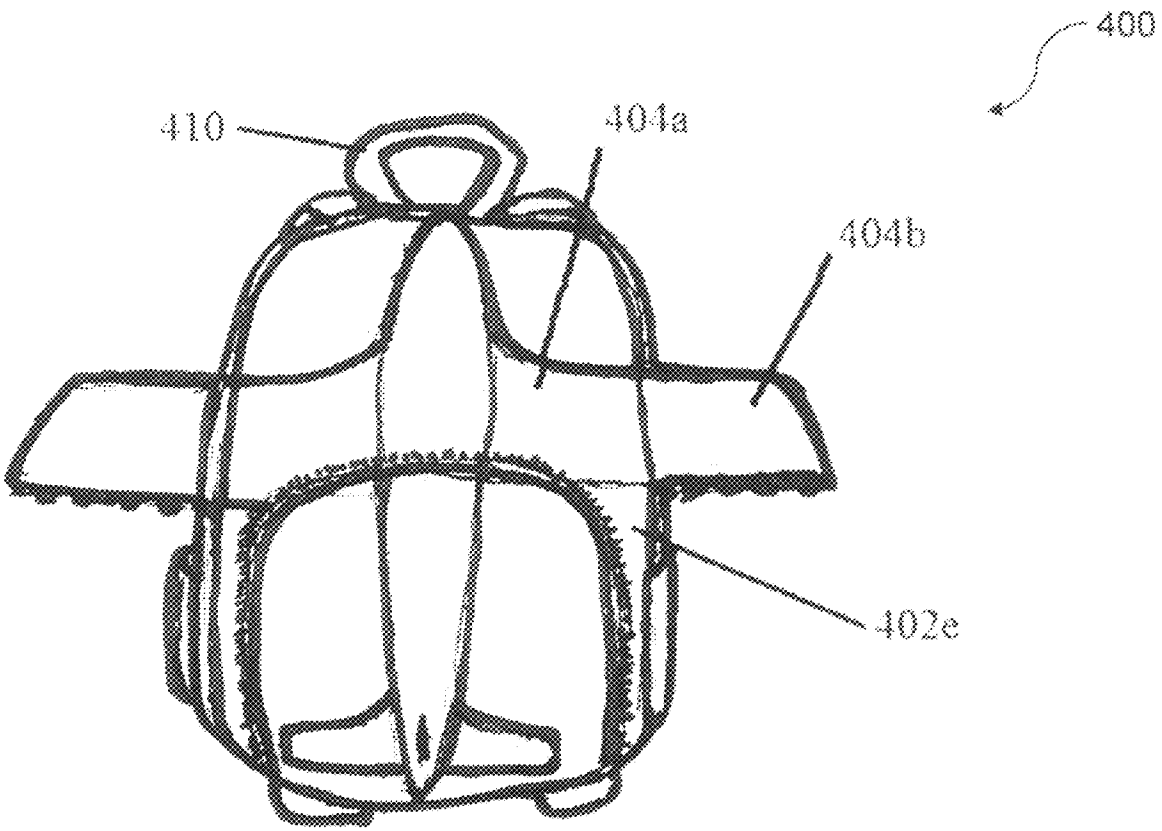
FIGS. 4A-4C depict a backpack and a visibility-enhancing portion, according to an embodiment.
Figure 4B:
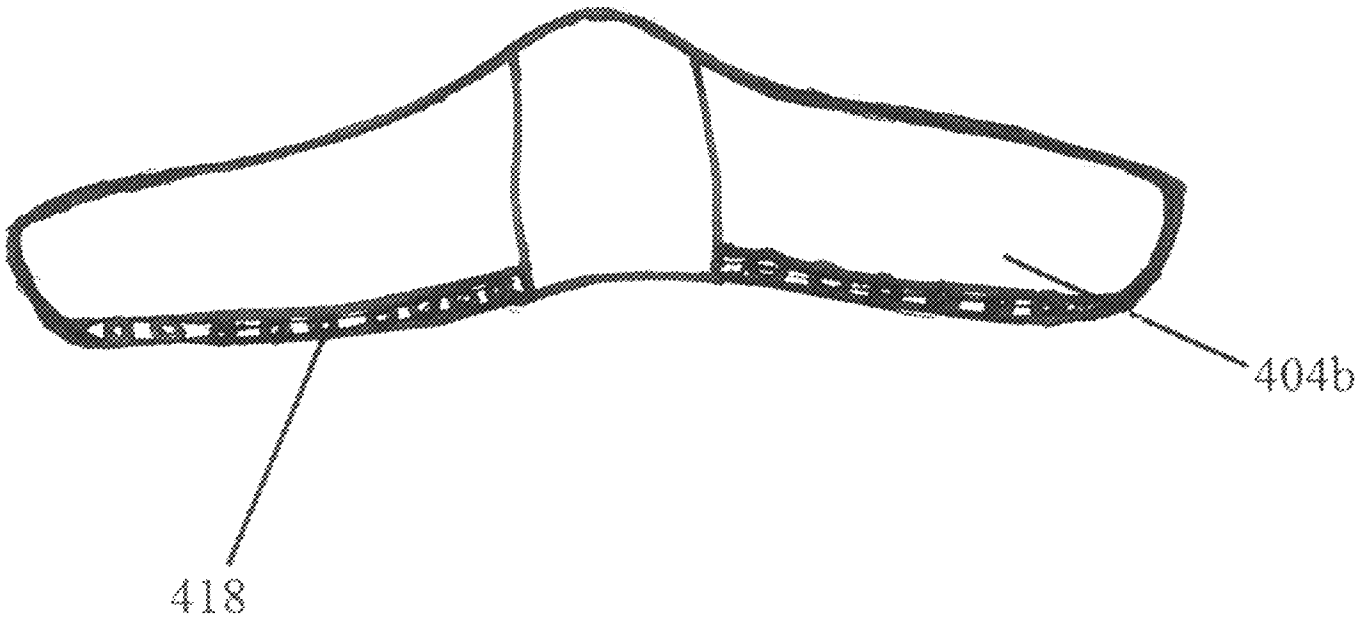
Figure 4C:
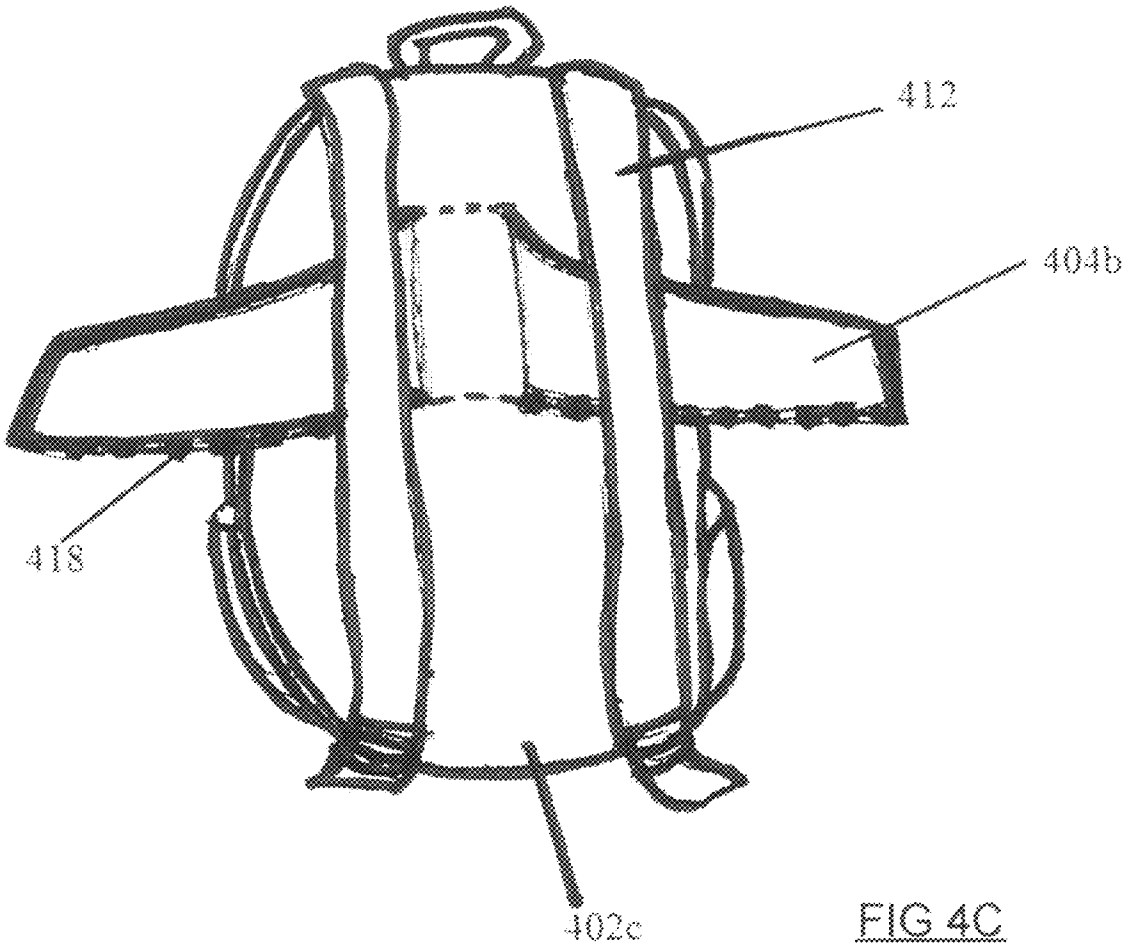

FIGS. 4A-4C show yet another embodiment of a visibility-enhancing system. In particular, FIGS. 4A-4C depict a system 400 in which the visibility-enhancing portion is made up of two parts, first portion 404*a* and second portion 404*b*. In alternative embodiments, more or fewer parts could be used to generate an aesthetic that appeals to a variety of users of the system 400. FIG. 4A shows system 400 from behind, giving the illusion of an airplane look to first portion 404*a* and second portion 404*b*. FIG. 4B shows a second portion 404*b* in isolation. FIG. 4C shows the system 400 from the wearer's side.

In FIGS. 4A-4C, first portion 404*a* and second portion 404*b* combine to make an airplane design, which may make the safety- and visibility-enhancing features of the system 400 more appealing to some children. As previously noted, a variety of different patterns and designs can be used, which appeal to a wide audience, to increase visibility of the largest range of children having different ages, genders, and interests. In the embodiment shown in FIGS. 4A-4C, in particular, the first portion 404*a* looks like a fuselage and some of the wing sections of an airplane, while second portion 404*b* makes up the remainder of the wing portions of the same airplane. The second portion, 404*b*, is similar to the visibility-enhancing portion 104 previously described with respect to FIGS. 1A-1C, in that it can be attached to the covered side 402*c*, between the covered side 402*c* and straps 412 such that, during use, the visibility-enhancing portions 404*a* and 404*b* give an appearance of an airplane.

Also similar to the previously-described embodiments, first portion 404*a* and second portion 404*b* can include LED lights 418, and/or any of a variety of reflective, movable, or otherwise visibility-enhancing portions, as previously described. These features improve visibility of children or other pedestrians wearing the system 400, which improves safety.

Various other embodiments using similar visibility-enhancing features can be used for different age groups and styles. In alternative embodiments, these features could be added to shoulder bags/messenger bags, or costumes such as Halloween costumes. The individual embodiments described herein each enhance visibility of a pedestrian, without being burdensome to carry, in that they are incorporated into an object that the pedestrian already would have carried. Furthermore, other styles and colors can be incorporated into the visibility-enhancing features to make them more stylish and attractive to children, and promote their wide-spread adoption.

In some embodiments, designs other than wings can be used, which are not necessarily positioned between an expected wearer of the bag and the bag itself. By way of example, a shark fin shaped visibility-enhancing portion can be attached or detached from the back of a backpack, satchel, or other container. In addition to the depicted or described embodiments, various other shapes, sizes, lighting patterns, and reflective patterns can be employed to promote pedestrian safety and visibility.

Various embodiments of systems, devices and methods have been described herein. These embodiments are given only by way of example and are not intended to limit the scope of the invention. It should be appreciated, moreover, that the various features of the embodiments that have been described may be combined in various ways to produce numerous additional embodiments. Moreover, while various materials, dimensions, shapes, configurations and locations, etc. have been described for use with disclosed embodiments, others besides those disclosed may be utilized without exceeding the scope of the invention.

Persons of ordinary skill in the relevant arts will recognize that the invention may comprise fewer features than illustrated in any individual embodiment described above. The embodiments described herein are not meant to be an exhaustive presentation of the ways in which the various features of the invention may be combined. Accordingly, the embodiments are not mutually exclusive combinations of features; rather, the invention can comprise a combination of different individual features selected from different individual embodiments, as understood by persons of ordinary skill in the art. Moreover, elements described with respect to one embodiment can be implemented in other embodiments even when not described in such embodiments unless otherwise noted. Although a dependent claim may refer in the claims to a specific combination with one or more other claims, other embodiments can also include a combination of the dependent claim with the subject matter of each other dependent claim or a combination of one or more features with other dependent or independent claims. Such combinations are proposed herein unless it is stated that a specific combination is not intended. Furthermore, it is intended also to include features of a claim in any other independent claim even if this claim is not directly made dependent to the independent claim.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims for the present invention, it is expressly intended that the provisions of Section 112, sixth paragraph of 35 U.S.C. are not to be invoked unless the specific terms "means for" or "step for" are recited in a claim.

I claim:

1. a visibility-enhancing system comprising:

a container;

at least one strap;

the at least one strap being connected with the container;

the at least one strap extending from the container;

a visibility-enhancing portion;

the visibility-enhancing portion being arranged in between the container and one of the at least one strap;

the visibility-enhancing portion extending at least partially beyond a perimeter of the container;

a plurality of LED lights;

the plurality of LED lights being disposed on the visibility-enhancing portion;

the visibility-enhancing portion comprising a main body and two angel wings such that the visibility-enhancing portion is in an angel wing shape;

the main body being connected in between the two angel wings;

a fastener provided on the main body, the main body being detachably coupled with an outer surface of the container via the fastener, such that the container and the visibility-enhancing portion are detachably coupled with each other;

the two angel wings each extending beyond the perimeter of the container; and the plurality of LED lights being arranged along an exterior edge of the main body and an exterior edge of each of the two angel wings.

2. The visibility-enhancing system of claim 1, wherein the visibility-enhancing portion comprises a reflective element.

3. The visibility-enhancing system of claim 1, wherein the fastener comprises a hook and a loop.

4. The visibility-enhancing system of claim 1 comprising: a printed portion; and the printed portion being formed on the container.

5. The visibility-enhancing system of claim 1, wherein the visibility-enhancing portion comprises a reflective element movably disposed on the visibility-enhancing portion.

6. The visibility-enhancing system of claim 1, wherein the at least one strap is reflective.

* * * * *